United States Patent [19]

Dahlgren et al.

[11] Patent Number: 4,527,471

[45] Date of Patent: Jul. 9, 1985

[54] DAMPENING FLUID REMOVAL DEVICE

[76] Inventors: Harold P. Dahlgren, 11 Turtle Creek, Dallas, Tex. 75204; James E. Taylor, 4129 Drowsy La., Dallas, Tex. 75233; Dwight W. Peters, Rte. 1, Box 50N, Grapevine, Tex. 75051

[21] Appl. No.: 492,402

[22] Filed: May 6, 1983

[51] Int. Cl.[3] ..... B41F 7/26; B41F 7/36; B41F 31/04

[52] U.S. Cl. ..... 101/148; 101/350; 101/426

[58] Field of Search ..... 101/148, 147, 350, 363, 101/351, 352, 365, 157, 169, 425, 206, 207, 208, 209, 210, 450, 451

[56] References Cited

U.S. PATENT DOCUMENTS

| | | | |
|---|---|---|---|
| 2,729,192 | 1/1956 | Warner | 118/117 |
| 3,182,632 | 5/1965 | Vazdikis | 118/104 |
| 3,343,484 | 9/1967 | Dahlgren | 101/148 |
| 3,559,572 | 2/1971 | Hackley | 101/350 |
| 3,701,335 | 10/1972 | Barnscheidt | 118/104 |
| 3,926,114 | 12/1975 | Matuschke | 101/350 X |
| 3,986,452 | 10/1976 | Dahlgren | 101/148 |
| 4,041,864 | 8/1977 | Dahlgren et al. | 101/350 |
| 4,208,963 | 6/1980 | Dahlgren | 101/148 X |
| 4,211,167 | 7/1980 | Corse | 101/148 |

FOREIGN PATENT DOCUMENTS

| | | | |
|---|---|---|---|
| 503420 | 6/1954 | Canada | 101/350 X |
| 2812998 | 11/1978 | Fed. Rep. of Germany | 101/350 X |

*Primary Examiner*—J. Reed Fisher

*Attorney, Agent, or Firm*—Gerald G. Crutsinger; John F. Booth; Monty L. Ross

[57] ABSTRACT

A method and apparatus to ink and dampen a lithographic printing plate including a dampening fluid removal device comprising a doctor blade positioned in pressure indented relation with a resilient inking roller to remove dampening fluid of low viscosity from the roller while leaving more viscous ink on the roller surface. The blade, therefore, is efficient to doctor dampening fluid while insufficient for printing ink.

16 Claims, 6 Drawing Figures

DAMPENING FLUID REMOVAL DEVICE

Printing plates for lithographic printing presses require application of dampening fluid to render hydrophilic non-image areas ink rejecting so that ink will adhere only to image areas which are oleophilic. Dampeners of the type disclosed in Dahlgren U.S. Pat. No. 3,937,141 applied a film of dampening fluid to a film of ink on an ink coated roller which in turn carried a composite film of ink and dampening fluid to the lithographic printing plate.

Dahlgren U.S. Pat. No. 4,088,074 disclosed an inker comprising a single resilient form roller which both ink and dampening fluid are applied therewith. In order to combat accumulation of excess dampening fluid in the reservoir, an air bar was employed for evaporating excess dampening fluid from the surface of the single form roller.

Corse U.S. Pat. No. 4,211,167 discloses an inker comprising a single resilient covered form roller to which both ink and dampening fluid are applied and a small rod parallel to the single form roller pressed under strong pressure against the soft surface layer of the form roller forms a barrier only against dampening fluid, while allowing all of the residual ink on the form roller to pass the rod and remain on the surface of the form roller.

The dampening fluid removal device disclosed herein relates to improvements in dampening fluid removal devices of the type disclosed in the aforementioned Dahlgren and Corse patents.

A primary object of the invention is to provide a dampening fluid removal device which is capable of selectively removing dampening fluid from ink to eliminate or reduce scumming, water streaking and plugging of lithographic printing plates.

Another object is to provide a dampening fluid removal device to enhance color density.

A further object is to provide a doctor blade and an ink metering member on a single ink coated form roller to selectively meter components of a composite film of ink and dampening fluid.

Other and further objects will become apparent upon reference to the following detailed description.

SUMMARY OF INVENTION

The improved dampening fluid removal device disclosed herein is employed in combination with a printing press applying ink and dampening fluid to a lithographic plate wherein dampening fluid having a viscosity of less than about one poise, is applied to the printing plate to render hydrophilic, nonimage, areas on the printing plate ink rejecting; and wherein ink, having a viscosity significantly greater than about one poise, is applied by an inker roller to oleophilic image areas on the printing plate. The dampening fluid removal device comprises a doctor blade positioned in pressure indented relation with an inking roller to engage ink and dampening fluid on the portion of the surface of the roller which has applied ink to the printing plate and before fresh ink is applied. The metering portion of the doctor blade is positioned at an angle relative to a line tangent to the roller surface to remove fluid having a viscosity less than a predetermined viscosity from the surface of the inker roller and to leave fluid having a viscosity greater than the predetermined viscosity on the surface of the roller. An oscillating idler roller forms a matte finish on the surface of any fluid left on the form roller to increase the adhesion of fresh ink to the film of fluid. After a fresh film of ink is applied onto the form roller, the fresh ink may be contacted by a material conditioning roller to form a matte, dampening fluid receptive finish on the surface of the fresh ink before dampening fluid is contacted thereby. The fresh film of ink and dampening fluid are then carried by the lithographic printing plate where both ink and dampening fluid are printed ultimately to a printing substrate. Excess dampening fluid attached to the ink on the form roller is removed by the ink removal device after the form roll has printed ink to the plate.

Adjustments are provided for adjusting the endentation of the doctor blade into the resilient roller surface and for adjusting the angle of the metering surface on the doctor blade relative to a line tangent to the roller for changing the efficiency of the doctor blade and causing a fluid of a smaller viscosity to be selectively removed from the fluid of a larger viscosity carried by the resilient surface of the form roller.

DESCRIPTION OF DRAWING

Drawings of the invention are annexed hereto, in which.

Numeral references are employed to designate like parts throughout the various figures of the drawing.

DESCRIPTION OF A FIRST EMBODIMENT

Figure 1:
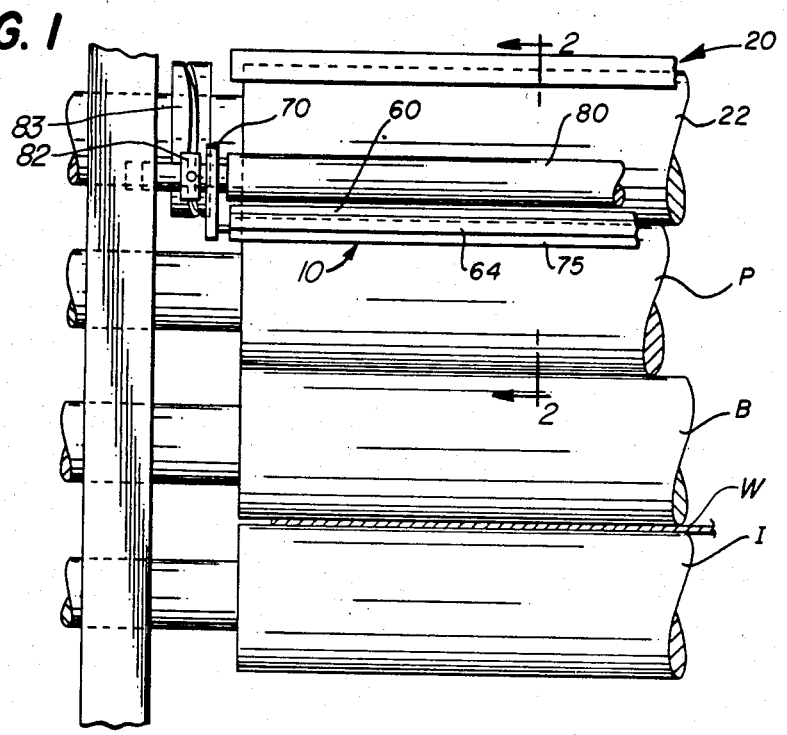
FIG. 1 is a fragmentary front elevational view of a lithographic printing press having the dampening fluid removal device mounted thereon.
Figure 2:
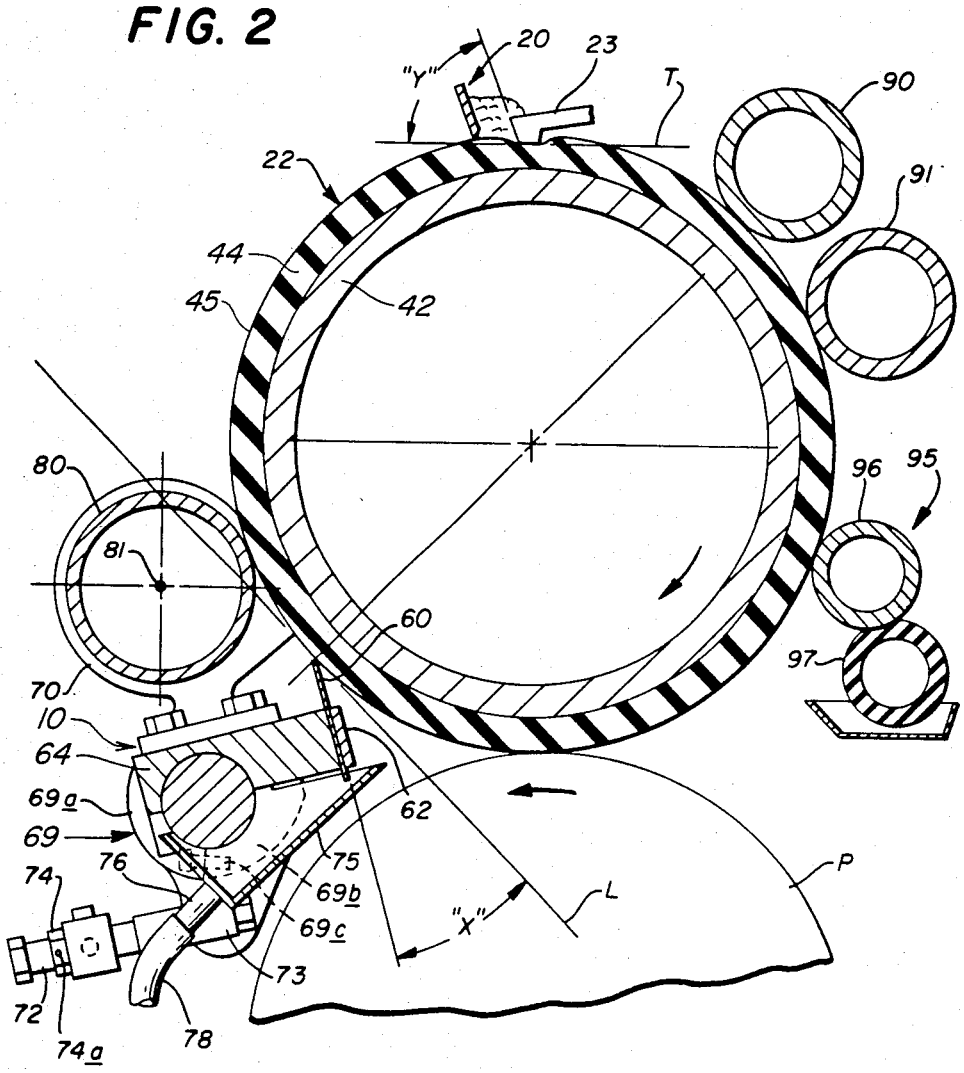
FIG. 2 is a cross sectional view taken along line 2—2 of FIG.1.

Referring to FIGS. 1 and 2 of the drawing, the numeral 10 generally designates the dampening fluid removing device mounted on a conventional offset lithographic printing press having a conventional plate cylinder p, blanket cylinder B, and impression cylinder I mounted therein for printing on a sheet or web of paper W.

The printing press is equipped with an inker 20 comprising a single inking form roller 22 having a resilient outer cover to provide a resilient surface which is engaged by an ink metering member generally designated by the numeral 23. Inker 20 will be more hereinafter fully described.

Dampening fluid removal device 10 comprises a doctor blade 60, which may comprise for example a flat strip of metallic material, such as stainless steel having a thickness of 0.020 inches. Blade 60 is sufficiently flexible to be deformed when urged into pressure indented relation with the resilient cover on form roller 22 to maintain substantially uniform pressure along the length of form roller 22 and along the edge of doctor blade 60.

Doctor blade 60 in the illustrated embodiment is disposed at an angle "X" of 30° to tangent line L.

Doctor blade 60 is secured by a clamp bar 62 to a mounting bar 64 having opposite ends rotatably secured between hangers 70 which are rotatably secured to the press side frames.

Figure 3:
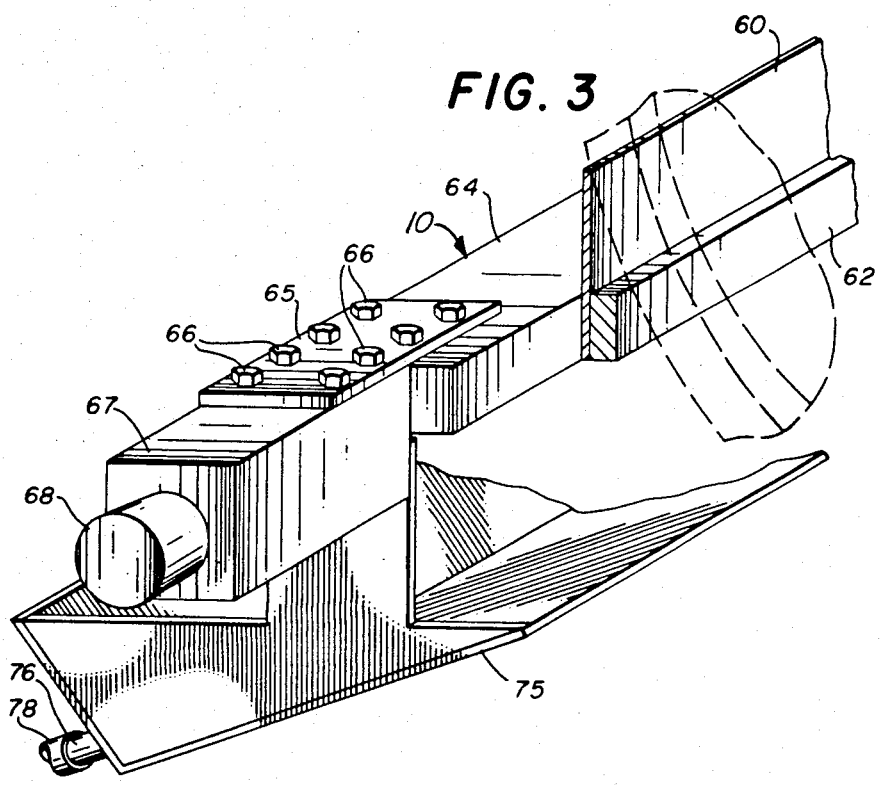
FIG. 3 is a fragmentary perspective view of the doctor blade and holder.

In the particular embodiment of the invention illustrated in FIG. 3 opposite ends of mounting bar 64 are secured by connector plates 65 and screws 66 to journal blocks 67 having a journal 68 extending outwardly therefrom. Journals 68 are mounted in bearings 69 in hanger 70.

Bearings 69 comprise split bearing blocks including semicircular bearing segments 69A and 69B and are secured together by screws 69C.

Thus, when screws 69C are loosened, journals 68 and doctor blade 60 can be rotated in bearing block segments 69A and 69B for adjusting the angular relationship between doctor blade 60 and a line L tangent to form roller 22.

In the particular embodiment of the invention illustrated in FIGS. 1 and 2 of the drawing, hangers 70 are pivotally mounted on journals extending outwardly from opposite ends of an oscillating idler roller 80. Idler 80 is adjustable radially to the cover of form roller 22. Each hanger 70 is equipped with an externally threaded adjustment screw 72 for adjusting indentation of the doctor blade 60 into the resilient surface of the form roller 22. Externally threaded screw 72 extends through an internally threaded anchor nut pivotally secured to the press side frame and the end of each adjustment screw 72 is rotatably secured in an anchor member 73 pivotally secured to the lower end of hanger 70. Thus, rotation of adjustment screw 72 causes hanger 70 and doctor blade 60 to rotate about the axis 81 of vibrator roller 80.

When the desired indentation of doctor blade 60 into the resilient cover of the form roller 22 is obtained, a lock nut 74 is moved into engagement with the anchor nut and secured in position by a set screw 74A to assure that the edge of doctor blade 60 will be repositioned in the same indented position with the surface of resilient form roller after doctor blade 60 has been moved out of indentation with the resilient roller surface for cleaning.

As will be hereinafter more fully explained, the pressure and angular relationship of doctor blade 60 relative to the surface of form roller 22 is maintained to prevent passage of low viscosity dampening fluid and an emulsion of ink and dampening fluid, comprising primarily dampening fluid, while leaving higher viscosity ink on the surface of form roller 22.

Dampening fluid removed from the surface of form roller 22 by doctor blade 60 flows by gravity downwardly into a dampening fluid collection tray 75 having downwardly inclined bottom walls. A drain pipe 76 communicates with the inside of tray 75 and dampening fluid collected therein is discharged through a hose 78 to waste or filtered and reused.

Vibrator roller 80 has a cam follower 82 secured to one end thereof which rides in a groove in cam disc 83 on form roller 22. If it is deemed expedient to do so, doctor blade 60 may oscillate with roller 80 by connecting hangers 70 to prevent movement of the hangers 70 longitudinally relative to vibrator roller 80.

Vibrator roller 80 forms a matte finish on the surface of any fluid left on the surface of form roller 22 to render the film of fluid more receptive to fresh ink.

A pair of material conditioning rollers 90 and 91 are urged into pressure indented relation with the film of fresh ink formed on the form roller 22 by the inker 20. Rollers 90 and 91 form a matte finish of the freshly metered film of ink to make the film of fresh ink more receptive to dampening fluid.

The dampener 95 is of the type disclosed in Dahlgren U.S. Pat. No. 3,343,484, the disclosure of which is incorporated herein by reference, and includes a hydrophilic transfer roller 96 and a resilient covered metering roller 97 urged into pressure indented relation. Transfer roller 96 and form roller 22 are driven at different surface speeds.

The resilient surfaced ink form roller 22 comprises a hollow, rigid, tubular metallic core 42 having a resilient non-absorbent cover 44 secured thereto, the cover having a uniformly smooth, uniformly textured, and resilient outer surface 45. The cover 44 on applicator roller 22, while being resilient, is relatively firm, for example, in a range between 30 and 70 Shore A durometer.

The cover 44 on resilient surfaced ink form roller 22 is preferably formed of a resilent urethane, polyurethane, rubber or rubber-like material attached to a metallic core 42. Preferably the cover is made from Buna Nitrile rubber which provides a natural surface having microscropic pores to receive and hold ink therein to enable metering a thin ink film suitable for lithographic printing applications.

The cover 44 on resilient surfaced ink form roller 22 should have high tensile strength, excellent tear and abrasion resistance, and resistance to oils, solvents and chemicals. The cover should, furthermore, have low compression set, good recovery, and uniform ink receptivity. A suitable cover can be formed using urethane or rubber to form a resilient cover preferably of about 60 Shore A durometer.

A suitable urethane cover may be made from a blocked, pre-catalized material which is commercially available from Arnco in South Gale, Calif., under the trademark "Catapol". The material is pre-heated at 160° F. for five hours, poured into a mold around the roller core, and then heated to 280° F. for 8½ hours, and allowed to cool prior to grinding and polishing.

A suitable rubber cover may be obtained from Mid-America Roller Company, Arlington, Tex., and specified as Buna-Nitrile which is conventionally formed over the core and ground with a high-speed grinder prior to polishing.

After a resilient cover 44 of either urethane or rubber has been formed, the roller may have a slick glazed outer skin or film over the surface thereof which is removed by grinding. After grinding with a 120 grit rock, the surface of resilient cover 44, if constructed of urethane, is sanded by using 180 grit sandpaper to form a surface of uniform smoothness over the surface 45 of the resilient cover 44. However, after grinding with a 120 grit rock, the surface of resilient cover 44, if constructed of rubber is sanded with 400 grit sandpaper to insure a velvet smooth, uniformly textured surface, free of "orange peel" or other surface irregularities.

Microscopic reservoirs into which ink is attached help to assure that a continuous unbroken film of ink is maintained on the surface 45 of resilient surfaced ink form roller 22.

Surface scratches, grind lines, and other surface irregularities should be removed so that the surface roughness of the surface of either urethane or rubber after sanding does not exceed 30 RMS. As will be hereinafter more fully explained, adhesive force between molecules of ink and molecules of the surface 45 of cover 44 must exceed cohesive force between ink molecules to permit shearing the ink to form a controlled, continuous, unbroken film of ink on the surface 45 of applicator roller 22.

It will be appreciated that it is physically impractical, if not impossible, to construct and maintain roller 22 such that surface 45 is perfectly round in a circumferential direction, perfectly straight in a longitudinal direction, and precisely concentric to the axis of core 42. The straightness or waviness of surface 45 on roller 22 can be economically manufactured within a tolerance of about 0.002 inches along the length of roller 22 and the radial eccentricity can be economically manufactured within a tolerance of about 0.0015 inches.

A Shore A durometer test is generally used to indicate the hardness of a resilient roller cover by measuring resistance to penetration at a constant temperature of about 76° F. while the resilient cover is stationary. The apparent hardness of a resilient surface under dynamic conditions deviates radically from the hardness indicated by the duromter test under static conditions. The spring constant of a resilient material also increases slightly as deformation increases.

As the frequency of loading of a resilient member increases, the dynamic modulus or apparent modulus of elasticity increases causing the cover to appear as a harder, stiffer material. However, cyclic loading of a resilient member results in generation of internal heat which increases temperature and results in a decrease in the durometer and therefore the modulus of elasticity of the resilient cover.

Further, since the surface 45 of cover 44 on roller 22 is preferably in pressure indented relation with the surface of a plate cylinder, the plate cylinder having a gap extending longitudinally thereof, this cyclic loading will result in generation of heat at an irregular rate circumferentially of the surface 45. Such temperature differences over surface 45 may cause an appreciable variation in the radial distance from the axis of the roller 22 to points over the surface 45, because the co-efficient of thermal expansion of elastomeric materials employed for forming resilient roller covers is several times the co-efficient of thermal expansion, of e.g. steel.

Roller 22 can be different in diameter than the plate cylinder p without adversely affecting printing of the film 130 to the web W, or sheet, since member 23 produces a continuous ribbon of ink on the applicator roller surface regardless of the prior impression and regardless of thermal changes within the roller cover 44.

DESCRIPTION OF SECOND EMBODIMENT

Figure 4:
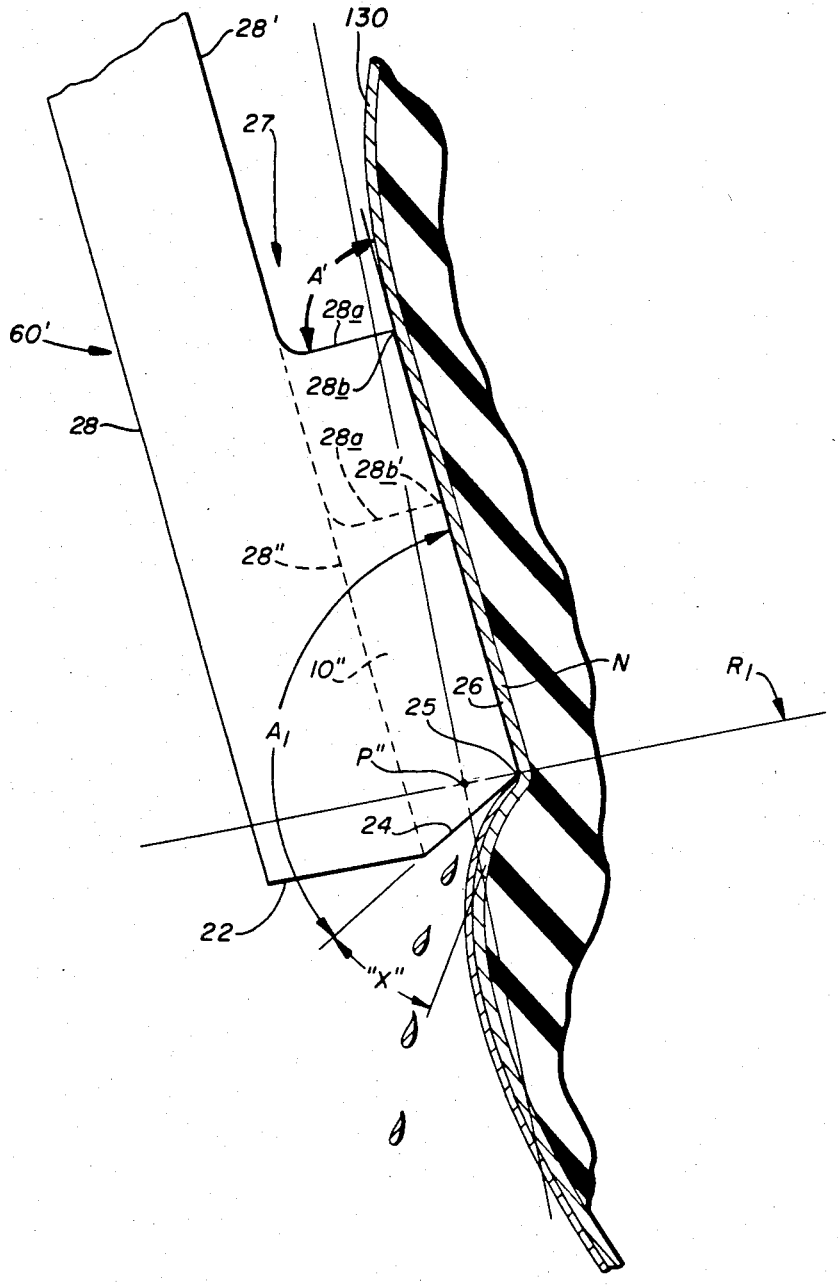
FIG. 4 is a cross sectional view similar to FIG. 2 of a second embodiment of the dampening fluid removal device.
Figure 5:
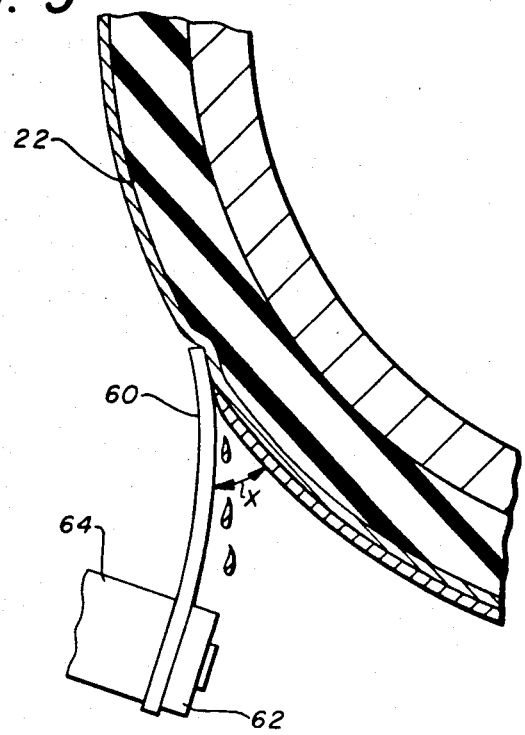
FIGS. 5 and 6 are enlarged details of the blade/roller interface in operation.
Figure 6:
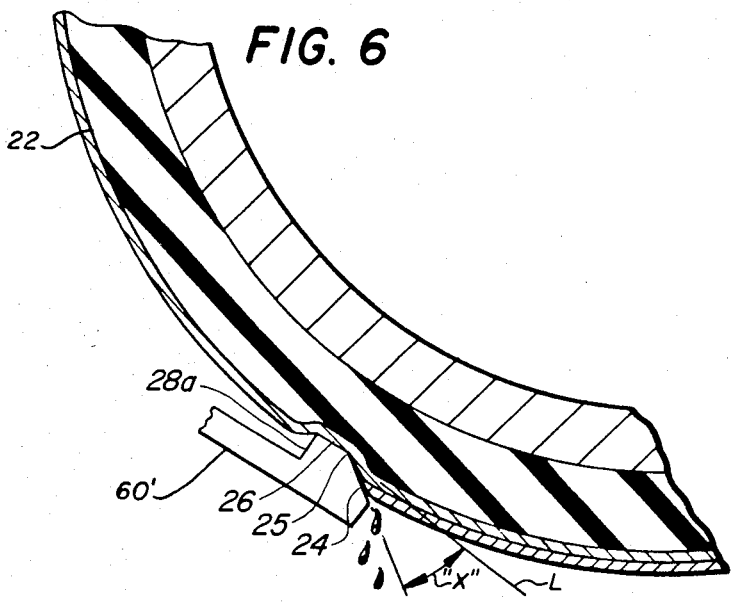

A second embodiment of ink removal member 60' is illustrated in FIGS. 4 and 6 of the drawings.

Referring particularly to FIG. 4, the ink metering member 60' has a smooth, polished, highly developed, precision metering edge 25 which is formed at the juncture of metering surface 24 and support surface 26.

Edge 25 is defined by the intersection of the polished surfaces 24 and 26. Polished surfaces 24 and 26 meet at an obtuse angle to form a wedge having an included edge bevel angle "$A_1$" which is approximately 150° or greater.

The edge 25 is preferably formed on relatively hard metallic material having a hardness of about Rockwell C48-50 or higher. It is important that the polished edge 25, surface 24, support surface 26, trailing surface **28*a* and edge 28*b* be wear resistant since they are indented into the resilient surface 45 of form roller 22** during normal operating conditions.

Member 60' is preferably a resilient, i.e., flexible, metallic, material having a modulus of elasticity of approximately $30\times10^6$ psi, or less, to provide what might be termed a "stylus effect" to the metering edge 25 as the form roller 22 rotates.

Member 60' has been formed with good results from a strip of stainless spring steel with sheared edges which is commercially available from Sandvik Steel, Inc., Benton Harbor, Mich., and distributed as Sandvik 7C27Mo2. The strip of stainless steel was selected for its hardness, flatness, resilience, grain structure and fine surface finish to provide high wear resistance and good fatigue properties. The stainless steel strip had a thickness of 0.070 inches and a width of approximately 3.000 inches. The strip of material had been heat treated and had a bright polished surface finish, extra accurate flatness and normal straightness. The tolerance of the width was ±0.016" and the tolerance of the thickness was ±0.00181 inches. The strip of stainless steel material was resistant to corrosion in the presence of air, water and most organic acid in dilute form at room temperature. The tensile strength was about 249,000 psi corresponding to the hardness of Rockwell C 49.

Initially, the edge, at the juncture of surfaces 24 and 26, had ragged notches forming a ragged edge contour. To form a precision straight edge to define an unbroken line across the extent of member 60, surfaces 24 and 26 were ground at a specified obtuse angle, then finished with a fine-grit stone as will be hereinafter more fully explained, as a first step in forming polished edge 25. The strip was then clamped in a special fixture. Surface 24 on the strip was superfinished at the specific angle by hand with a fine grit stone and then hand polished with 600 grit sandpaper.

As a final step, the stainless steel strip was positioned on a flat horizontal surface. Surface 26 was then superfinished by hand with a stone having a fine grit and hand polished with 600 grit sandpaper.

If a feather edge forms on the member while portions of surfaces 24 and 26 are being superfinished and polished, the feather edge should be removed with leather or a polishing material. When the feather, or wire-like irregular edge is removed, a smooth, continuous, uniform, blemish-free edge is formed on the strip. Thus, in the process of polishing or "sharpening" the obtuse edge 25, the acuteness of the edge may be altered somewhat to form a noncutting, non-film-piercing edge. This process produces a fine, continuous, smooth, straight, polished, highly developed, uniform, superfinished, edge 25, having minimal surface irregularities. There should be no small notches or protrusions in the edge. The developed edge 25, formed by polished surfaces 24 and 26, is an extremely fine edge which has been polished to bring it to a highly developed finish, and as nearly perfect condition as possible. Surfaces 24 and 26 are preferably finished to an RMS reading not exceeding RMS 4. The term "superfinishing" as used herein applies to a surface which has been ground and polished such that the peaks of the surface have been removed to form flat bearing surfaces, yet still having minute valleys or reservoirs for accepting and carrying the lubricant dampening fluid and ink.

Edge 25 is finished to a surface finish approximating that of the edge of a razor blade. However, it will be appreciated that the obtuse angle "$A_1$" between surfaces 24 and 26 is significantly greater than the bevel angle on a razor blade and thus an obtuse, blunt, noncutting and non-piercing edge is formed. Actually, surface 24 blends into surface 26 through edge 25 to form a continuous polished surface adjacent each side of edge 25.

The material used to form the edge 25 must not only be hard and capable of being formed to provide a blunt, fine, polished, unbroken, edge, but the material must also be dense yet flexible along the length of the edge 25. In fact, the edge 25 must be quite flexible in a lengthwise direction so that when urged into pressure indented relation with the resilient surface of resilient surfaced ink form roller 22, the edge 25 will be flexed, yielding to the influence of the surface of roller 22, to conform the edge 25 and the surface of roller 22 to form a substantially uniform indented area along the length of roller 22. As will be hereinafter more fully explained, the resilient cover 44 on roller 22 has a thickness in the range of approximately $\frac{3}{8}$ to $\frac{5}{8}$ inches, preferably $\frac{1}{2}$ inch, and a resilience of about 30 to 70 Shore A durometer, preferably 60 durometer, Shore A. This loading of edge 25 to obtain conformation with the surface of roller 22 should be possible without excessively indenting the surface of the roller when in a dynamic, running condition.

The edge 25 on member 60' should be mounted so that it is resiliently urged toward the surface of the resilient surfaced ink form roller 22 and is free for movement along its entire length in a direction radial to the applicator roller. Also, the edge 25 must be rigidly supported in a direction substantially tangent to the applicator roller surface.

The ideal support for the edge 25 is a flexible cantilever beam which supports the edge 25 and provides the required bias and rigidity. Although the edge 25 may be a part of a separate trapezoidal like element, which is functionally associated with a cantilever beam, it is preferable to form the edge 25 of the trapezoidal portion 10 on the beam so that the two are an integral unit. To accomplish this, the beam must be flexible in two directions; namely, along the length of the edge 25 and also along the width of the strip, i.e., the length of the cantilever beam.

The member illustrated in FIG. 6 of the drawing, wherein the edge 25 is formed on the unsupported end of the cantilever beam, has a substantially rectangular cross section. Support surface 26 lies substantially parallel to the plane of surface 28, when the cantilever beam is in a non-flexed condition. Surface 24 and support surface 26 intersect forming an obtuse angle "$A_1$" and intersect at an apex 25, which is substantially a straight line.

As an example, the cantilever beam which includes the obtuse edge 25 may be formed from a thin, flexible, elongated stainless steel strip or band, as hereinbefore described, having a thickness of 0.070 inches and a width of 3.0 inches, or less. The width of the beam, or the length of the strip of material, will preferably be within the range of from 10 to 80 inches, and the beam is supported to be flexible along the length of edge 25 as well as along the length of the cantilever beam. The modulus of elasticity E of the beam may be, for example $29 \times 10^6$ psi, which represents the stiffness of the material; that is, its resistance to deformation. When combined with the moment of inertia I, the EI factor represents the stiffness of the cantilever beam.

The specific dimensions and characteristics of the metering member 60' are presented by way of explanation, and such dimensions, characteristics and mounting may vary to meet specific conditions. Consequently, preferable ranges have been provided herein.

Member 60' also has a groove or relieved area 27 formed in the lower surface 29 of the strip of material from which member 60' is formed.

The portion of the strip of material which will be polished to form polished edge 25 is masked and the metallic material adjacent thereto is removed by grinding or by chemically milling to remove a portion of the metal without creating stresses that would cause the strip of material to warp.

Surface **28*a* adjacent the support surface 26 is smoothed by finish grinding to remove approximately 0.003 inch of rough surface material. Surface 28*a* may then be sanded with 600 grit paper to provide a very smooth surface finish on the surface of 28*a*. Edge 28*b* is therefore formed as discussed previously for edge 25**.

If the thickness, the distance between surfaces 26 and 28, of the strip of material is 0.070 inches, the depth of the relieved area 27 is preferably greater than 0.020 inches, for example, 0.035 inches, such that the thickness of the material between surface 28' and surface 28 is approximately 0.035 inches.

Surface **28*a* intersects the polished surface 26 at an angle A' in a range between 30° and 90° as shown. The upper portion of surface 24 of metering member 10' may extend to surface 28 or be bevelled as shown at an angle to form surface 22**.

Surface 24 may therefore be only a small champher. Obtuse angle "$A_1$", not only forms a member having a blunt, obtuse, edge which is not fragile, but, primarily is specifically formed to a particular angle, or configuration, to enable the doctor of a specific film having a specific viscosity to doctor the film without an immediate change in deflection of the roller surface and without significant indentation of the roller cover which causes rapid wear of the member edge and the roller cover.

In the illustrated embodiment of metering member 60', polished surface 24 extends upwardly from polished edge 25 a distance approximately equal to the depth of relieved area 27, or greater. It should be readily apparent that polished surface 26 supports the polished edges 25 and **28*b*. If surfaces 24 and 28*a* are parallel, surface 26 can be refinished without changing the load bearing characteristics of the polished edge portion 25 of the metering member 60'**.

Surfaces 26, 24 and **28*a*, and therefore edges 25 and 28*b*, are readily renewable. By slightly refinishing support surface 26, both edges may be resharpened simultaneously; or, surfaces 24 and 26 may also be refinished. After considerable usage, a small radius or curve may appear at edge 25 to cause changes in doctoring characteristics. To avoid replacing the entire member, the hereinbefore stated, post-grinding and hand-finishing procedures may be again performed several times before the entire member is replaced. Normally one to three thousandths of an inch is removed from any one surface, depending upon the extent of wear to restore edges 25 and 28*b***.

A special fixture or fixtures may be used when refinishing surfaces 24 and 26 in order to prevent damage to the metering member. The fixture should not only hold the member, but also provide guide surfaces for the fine grit stoning and sanding operations to insure that only a minimum amount of material is removed and that the obtuse angle "$A_1$" and edges 25 and **28*b*** are maintained.

The relief angle A' should be sufficient to cause an ink film carried by the surface of roller 22 to depart and separate from surface 26 without accumulating either on surface 26 or 28*a* to cause ultimate dripping of the accumulated ink to cause non-uniformity of printing.

Lithographic printing ink for web-fed, offset presses has a viscosity in a range of about 100 to 200 poises while lithographic printing ink for sheet-fed offset presses has a viscosity of about 200 to 265 poises.

The ink metering member 23 of inker 20 and the doctor member 60' of the illustrated second embodiment are identical except that the angle "X" between tangent line L and metering surface 24 of metering member 60' is about thirty degress, plus or minus fifteen degrees, while the angle "Y" between the metering surface of metering member 23 and tangent line T is about forty-five degrees, plus or minus fifteen degrees.

By selecting doctor members 60 or 60' and ink metering member 23 with different angles "X" or "Y" relative to a line tangent to the form roller 22, liquids of different viscosities can be selectively metered. If the angle "X" is substantially the same as angle "Y", the metering edge on the ink metering member 23 will be indented a greater distance into the resilient form roller cover than the edge on member 60 or 60'.

Having described our invention, we claim:

1. A method of inking a lithographic printing plate wherein dampening fluid having a viscosity of less than one poise, is applied to the printing plate to render hydrophilic, non-image areas, on the printing plate ink rejecting; and wherein ink, having a viscosity significantly greater than 10 poise, is applied by an inking roller, having a resilient surface, to oleophilic, image, areas on the printing plate at an inking nip, the improvement comprising the steps of: positioning a doctor blade having a leading edge and a trailing edge in pressure indented relation with the resilient surface on an inking form roller to engage ink and dampening fluid on the portion of the surface of the inking roller which has applied ink to the printing plate and before fresh ink is applied to the portion of the inking roller surface such that dampening fluid on the ink, carried by the resilient roller surface, impinges against a substantially flat metering surface on said doctor blade adjacent to the edge; urging both the metering edge and the trailing edge in a direction generally radially of the form roller to urge both the metering edge and the trailing edge into indented relation with the roller surface; resiliently supporting the doctor blade in a direction radially of the form roller to permit movement of the metering edge relative to the axis of the form roller; positioning the metering surface of the doctor blade at an angle relative to a line tangent to the roller surface to remove dampening fluid having a viscosity less than a predetermined viscosity from the surface of the inking roller and to leave ink having a viscosity greater than the predetermined viscosity on the surface of the inking roller; and applying fresh ink having a viscosity greater than said predetermined viscosity to the portion of the inker roller surface from which dampening fluid having a viscosity less than said predetermined viscosity has been removed.

2. The method of claim 1 with the addition of the step of: adjusting pressure urging the doctor blade into pressure relation with the resilient roller surface to change the indentation of the doctor blade into the resilient roller surface.

3. The method of claim 1 wherein the roller is a single inking form roller in pressure indented relation with the lithographic printing plate.

4. The method of claim 3 with the addition of the step of: rotating an idler roller in pressure indented relation with the single inking form roller to form a matte surface on the ink on the form roller from which dampening fluid has been removed by the doctor blade before applying fresh ink to increase the adhesion of fresh ink to the film of ink remaining on the inking roller.

5. The method of claim 4 wherein the metering surface on the doctor blade is positioned at an angle between 45 degrees and 15 degrees relative to a line tangent to the inking roller.

6. The method of claim 4 with the addition of the step of: oscillating the idler roller longitudinally relative to the inking roller.

7. The method of claim 3 with the additional step of rotating a material conditioning roller in pressure indented relation with the surface of the single form roller to form a matte finish on the surface of the fresh ink before applying dampening fluid to increase the adhesion of dampening fluid to the fresh film of ink.

8. The method of claim 3 wherein the dampening fluid is metered between a resilient surfaced metering roller surface and a hard hydrophilic surfaced roller; and with the addition of the step of: rotating the hard hydrophilic surfaced roller at a surface speed which is different from the surface speed of the inking form roller to transfer dampening fluid to ink on the form roller; and rotating the inking form roller to apply dampening fluid and ink to the printing plate.

9. The method of claim 1 wherein the step of applying fresh ink comprises the steps of: positioning a metering member having a metering edge and a trailing edge in pressure indented relation with the resilient surface on said inking form roller such that ink carried by the resilient roller surface impinges against a substantially flat metering surface on said metering member adjacent to the metering edge; urging both the metering edge and the trailing edge in a direction generally radially of the form roller to urge both the metering edge and the trailing edge into indented relation with the resilient roller surface; resiliently supporting the metering member in a direction radially of the form roller to permit movement of the metering edge relative to the axis of the form roller; and supporting said metering edge to prevent movement of the metering edge in a direction tangent to the form roller.

10. A method of inking a lithographic printing plate wherein dampening fluid having a viscosity of less than one poise, is applied to the printing plate to render hydrophilic, non-image areas, on the printing plate ink rejecting; and wherein ink, having a viscosity significantly greater than 10 poise, is applied by an inking roller, having a resilient surface, to oleophilic, image, areas on the printing plate of an inking nip, the improvement comprising the steps of: positioning a doctor blade having a leading edge and a trailing edge in pressure indented relation with the resilient surface on a single inking form roller to engage ink and dampening fluid on the portion of the surface of the inking roller which has applied ink to the printing plate and before fresh ink is applied to the portion of the inking roller surface such that dampening fluid on the ink, carried by the resilient roller surface, impinges against a substantially flat metering surface on said doctor blade adjacent to the edge; urging both the metering edge and the trailing edge in a direction generally radially of the single form roller to urge both the metering edge and the trailing edge into indented relation with the roller surface; resiliently supporting the doctor blade in a direction radially of the form roller to permit movement of the metering edge relative to the axis of the form roller; and supporting said metering edge to prevent movement of the metering edge in a direction tangent to the single form roller; positioning the metering surface of the doctor blade at an angle relative to a line tangent to the roller surface to remove fluid having a viscosity less than a predetermined viscosity from the surface of the inking roller and to leave fluid having a viscosity greater than the predetermined viscosity on the surface of the inking roller; and positioning a metering member having a metering edge and a trailing edge in pressure indented relation with the resilient surface on said single inking form roller such that ink carried by the resilient roller surface impinges against a substantially flat metering surface on said metering member adjacent to the metering edge; urging both the metering edge and the trailing edge in a direction generally radially of the form roller to urge both the metering edge and the trailing edge into indented relation with the resilient roller surface; resiliently supporting the metering member in a direction radially of the form roller to permit movement of the metering edge relative to the axis of the form roller; supporting said metering edge to prevent movement of the metering edge in a direction tangent to the form roller; applying fresh ink having a viscosity greater than said predetermined viscosity to the portion of the inker roller surface from which fluid having a viscosity less than said predetermined viscosity has been removed, wherein the dampening fluid is metered between a resilient surfaced roller and a hard hydrophilic surfaced roller; rotating the hard hydrophilic surfaced roller at a surface speed which is different from the surface speed of the inking form roller to transfer dampening fluid to ink on the form roller; and rotating the form roller to apply dampening fluid and ink to the printing plate.

11. The method of claim 10 with the addition of the step of: adjusting the angle of the metering surface of the doctor blade relative to a line tangent to the roller.

12. The method of claim 10 with the addition of the step of: adjusting pressure urging the doctor blade into indented relation with the resilient roller surface to change the indentation of the doctor blade into the resilient roller surface.

13. The method of claim 10 with the addition of the step of positioning the metering surface on a doctor blade so that the angle between the metering surface and a line tangent to the roller is between 45 degrees and 15 degrees.

14. The method of claim 10 with the addition of the step of oscillating the doctor blade longitudinally relative to the inking roller.

15. A method of inking a lithographic printing plate wherein dampening fluid having a viscosity of less than one poise, is applied to the printing plate to render hydrophilic, non-image areas, on the printing plate ink rejecting; and wherein ink, having a viscosity significantly greater than the viscosity of dampening fluid, is applied by an inking roller, having a resilient surface, to oleophilic, image, areas on the printing plate of an inking nip, the improvement comprising the steps of: positioning a metering member having a metering edge and a trailing edge in pressure indented relation with the resilient surface on said inking form roller such that ink carried by the resilient roller surface impinges against a substantially flat metering surface on said metering member adjacent to the metering edge; urging both the metering edge and the trailing edge in a direction generally radially of the form roller to urge both the metering edge and the trailing edge into indented relation with the resilient roller surface; resiliently supporting the metering member in a direction radially of the form roller to permit movement of the metering edge relative to the axis of the form roller; supporting said metering edge to prevent movement of the metering edge in a direction tangent to the form roller; applying dampening fluid to the metered film of fresh ink; rotating the form roller to apply ink and dampening fluid to the printing plate; positioning a doctor blade in pressure indented relation with the resilient surface of the inking form roller to engage ink and dampening fluid on the portion of the surface of the inking roller which has applied ink to the printing plate and before fresh ink is applied to the portion of the inking form roller surface; positioning a flat metering surface of the doctor blade at an angle relative to a line tangent to the roller surface to remove fluid having a viscosity less than a predetermined viscosity from the surface of the inking form roller and to leave fluid having a viscosity greater than the predetermined viscosity on the surface of the inking form roller; and applying fresh ink having a viscosity greater than said predetermined viscosity to the portion of the inker form roller surface from which fluid having a viscosity less than said predetermined viscosity has been removed by the doctor blade.

16. The method of claim 15 wherein the steps of positioning the doctor blade comprises the steps of: positioning a doctor blade having a leading edge and a trailing edge in pressure indented relation with the resilient surface on said inking form roller such that dampening fluid carried by the resilient roller surface, impinges against a substantially flat metering surface on said doctor blade adjacent to the edge; urging both the metering edge and the trailing edge on the doctor blade in a direction generally radially of the form roller to urge both the metering edge and the trailing edge into indented relation with the roller surface; resiliently supporting the metering edge on the doctor blade in a direction radially of the form roller to permit movement of the metering edge radially relative to the axis of the form roller; and supporting said metering edge to prevent movement of the metering edge on the doctor blade in a direction tangent to the inking form roller.

* * * * *